United States Patent [19]

Limp

[11] Patent Number: 4,769,958

[45] Date of Patent: Sep. 13, 1988

[54] CLEAN-ROOM SUSPENDED CEILING

[76] Inventor: Edgar W. Limp, 1103 E. Campbell, Arlington Heights, Ill. 60004

[21] Appl. No.: 804,670

[22] Filed: Dec. 3, 1985

[51] Int. Cl.[4] ..... B01D 46/10; E04B 5/55

[52] U.S. Cl. ..... 52/39; 52/484; 98/40.05; 55/355; 55/385.1

[58] Field of Search ..... 52/484, 489, 665, DIG. 8, 52/39; 55/355, 385 A, 483, 494; 98/40 D, 40 DL, 115 SB

[56] References Cited

U.S. PATENT DOCUMENTS

| | | | |
|---|---|---|---|
| 3,360,910 | 1/1968 | Soltis | 55/483 |
| 3,374,596 | 3/1968 | O'Brien | 52/484 |
| 3,486,311 | 12/1969 | Allan | 55/385 A |
| 3,742,674 | 7/1973 | Lang | 52/484 |
| 3,782,082 | 1/1974 | Smith et al. | 55/494 |
| 3,861,105 | 1/1975 | Starks | 52/489 |
| 3,986,850 | 10/1976 | Wilcox | 55/385 A X |
| 4,034,531 | 7/1977 | Balinski | 52/484 |
| 4,344,784 | 8/1982 | Deckas et al. | 55/483 X |
| 4,477,263 | 10/1984 | Shaver et al. | 55/385 A X |
| 4,511,380 | 4/1985 | Fetter | 55/483 |
| 4,518,405 | 5/1985 | Lough et al. | 55/385 A |
| 4,541,216 | 9/1985 | Head | 52/489 |
| 4,545,793 | 10/1985 | Shuler | 52/484 |
| 4,559,751 | 12/1985 | Rogers | 52/665 |
| 4,570,391 | 2/1986 | Quante et al. | 52/39 |
| 4,639,261 | 1/1987 | Pittman et al. | 55/483 X |

FOREIGN PATENT DOCUMENTS

| | | | |
|---|---|---|---|
| 400502 | 4/1966 | Switzerland | 52/665 |

*Primary Examiner*—J. Karl Bell

*Attorney, Agent, or Firm*—Eugene F. Friedman

[57] ABSTRACT

A suspended ceiling system for a clean room employing short cross runners connected to longer main runners. The connections serve to coax the cross runners against the main runners to keep the system intact and air tight. The grid of cross and main runners creates rectangular areas between them into which ledges extend from both runners. For a dry seal, a sealing gasket adheres to the ledges' upper surface. Ceiling components such as lights, filters, and tiles sit upon the gasket to provide the seal. For a wet seal, a trough sits upon the ledge and circumscribes each rectangular area. The trough contains a liquid material into which a knife edge depending from the ceiling fixtures sits. A continuous threaded slot runs along the center of the members' bottoms. This allows the attachment of accessories such as removable walls. The runners have a generally U-shaped cross section that gives it sufficient strength to bear the live weight of a person. Between the upright arms, the member have sufficient space to hold a room sprinkler and electrical conduit and piping.

22 Claims, 2 Drawing Sheets

FIG. 2
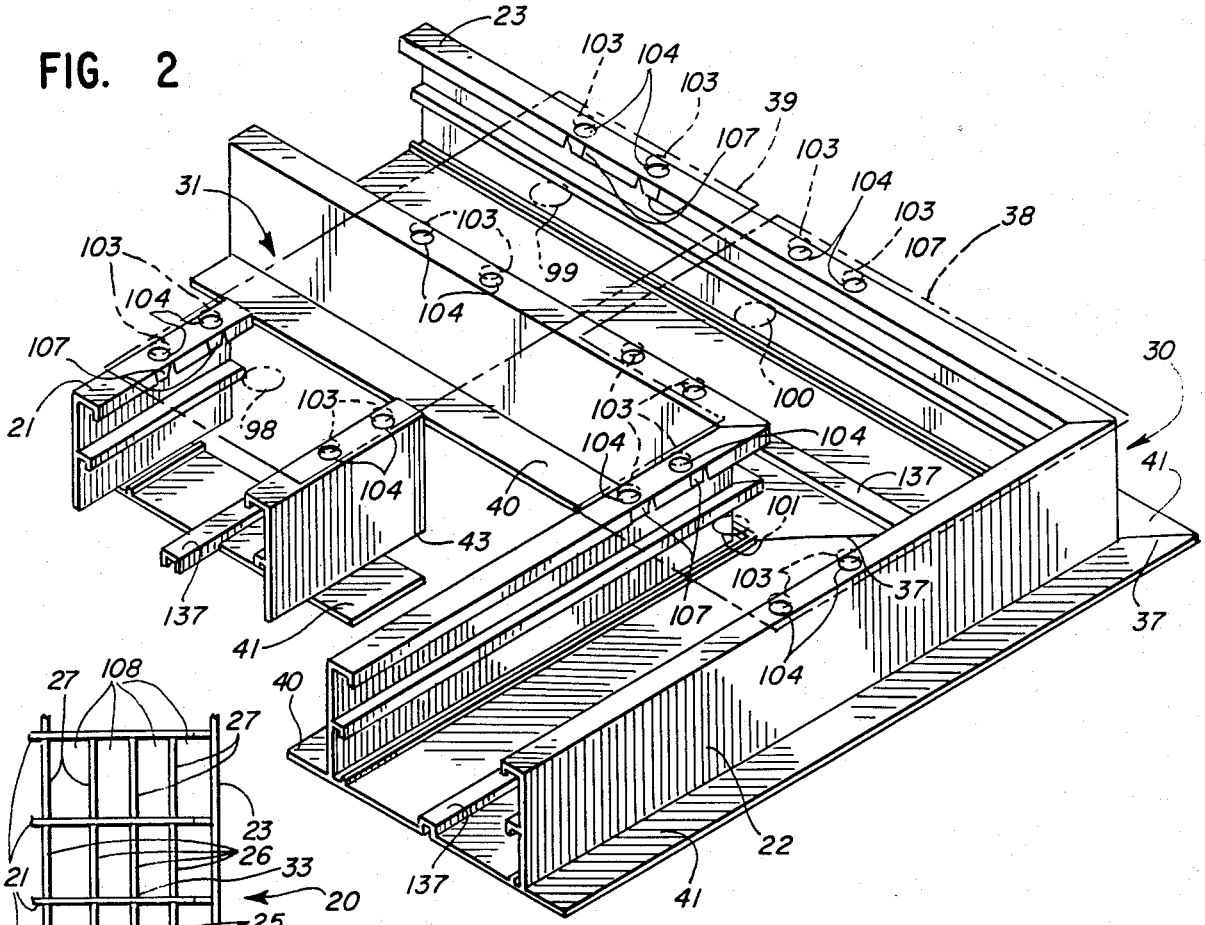
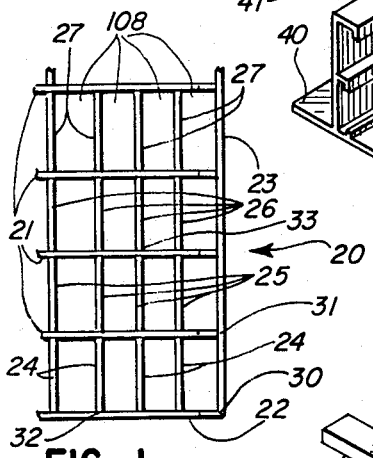
FIG. 1
FIG. 3
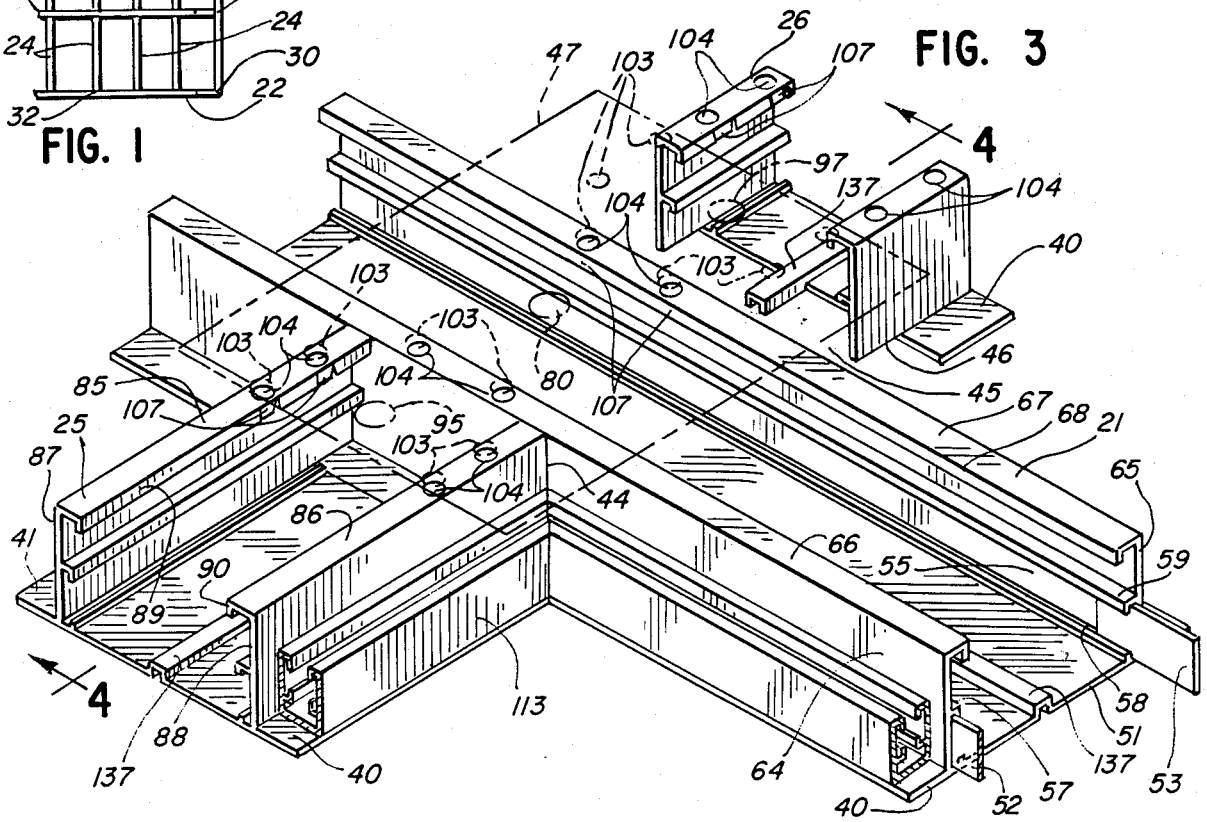

FIG. 4
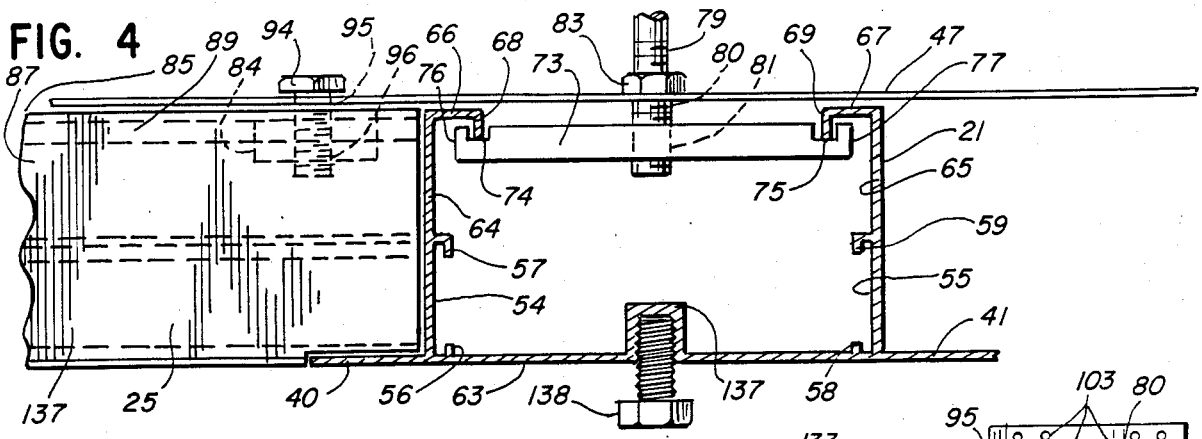
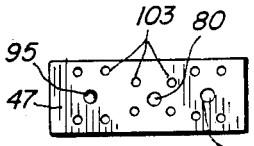
FIG. 5
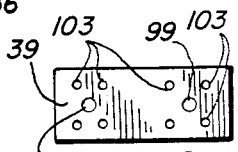
FIG. 6
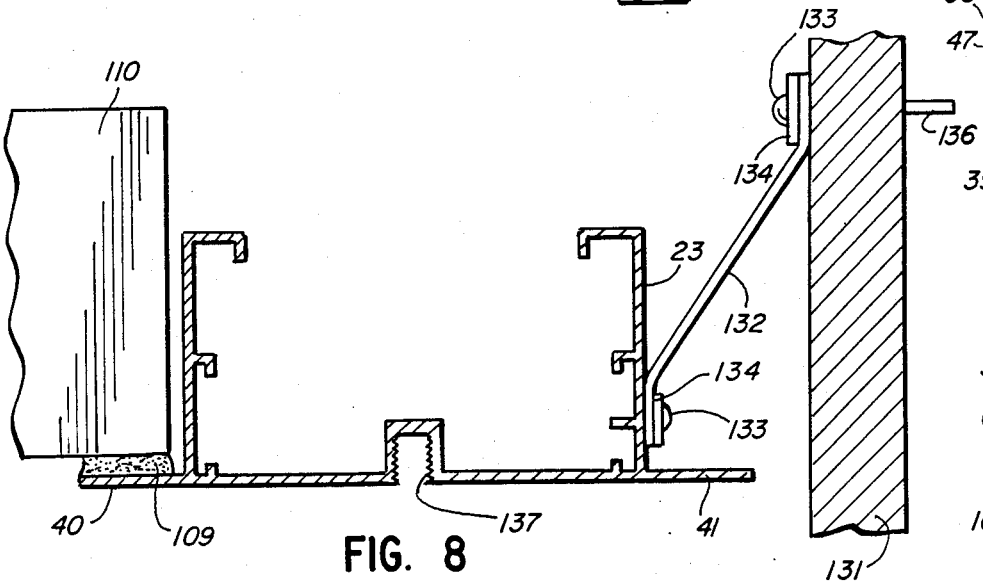
FIG. 8
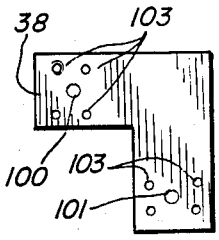
FIG. 7
FIG. 9
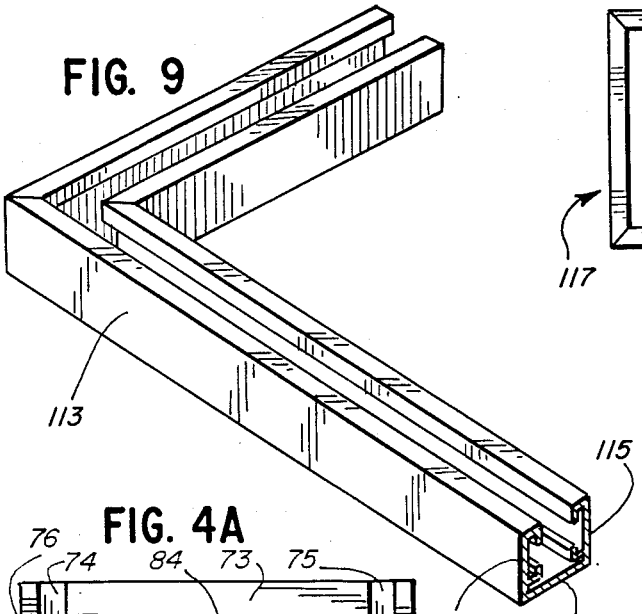
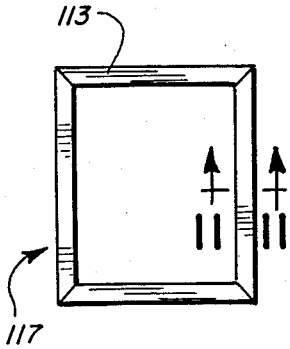
FIG. 10
FIG. 4A
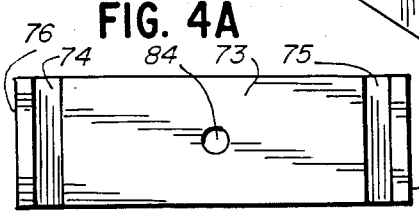
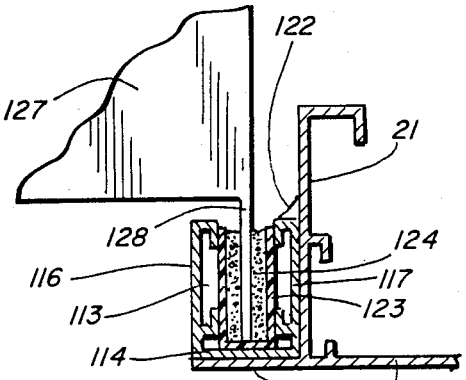
FIG. 11

CLEAN-ROOM SUSPENDED CEILING

BACKGROUND

A clean room must have a ceiling that prevents the entrance into the room of impermissible dirt particles. The standard hard ceiling of a room generally will not suffice for this purpose. Additionally, the passage into the clean room of required services such as electricity, plumbing, and ventilation often proceeds through the clean room's ceiling. All of these factors generally tend to indicate the use of a dropped, suspended ceiling for a clean room.

The dropped ceilings that have found use for clean rooms, however, display serious limitations. These ceilings have generally required the permanent installation of a structure including the usual ceiling components which include electrical fixtures, ventilating units and tiles. This on-site construction involves a substantially higher cost that the use of prefabricated regular ceilings. Additionally, these individually designed and constructed ceilings, of course, would not have utility at different locations or in different rooms.

Additionally, the permanently installed ceilings do not provide facile ingress of the required services such as electrical, plumbing, and communication. Furthermore, they also do not have a convenient manner of providing room sprinklers when a particular installation requires them.

Further, clean rooms may fall within the moderately strict requirements down to class 100 (i.e. not more than 100 particles of 0.5 microns in size per cubic foot of air) which may use a dry seal, such as a gasket, to hold ceiling components. Drastically cleaner rooms below class 100 generally require a wet seal utilizing petroleum jelly to prevent the flow of air. Present clean rooms do not permit the facile interchange from one type of room to another.

Accordingly, the search continues for a suspended ceiling for a clean room that can utilize prefabricated components. Moreover, it should allow the facile ingress of the required services. Desirably, the ceiling should readily undergo the interchange between differing standards of cleanliness as the room's use requires.

SUMMARY

To provide a suspended ceiling system for a clean room utilizes initially a first plurality of first elongated support members. These members, or main runners, may run the length or width of the room. Furthermore, a main runner may represent a single solid item or several separate pieces joined together. A suspending means, coupled to these first members, holds them at a predetermined height of the floor of the room.

To connect the first support members together, the system includes a second plurality of second elongated members. Each of the members of the second group has a shorter length than those in the first group. The shorter members, of course, represent the cross runners connecting the main runners.

To adjoin the first and second members together, the system includes a connecting device which couples to the two sets of members. The connector first affixes one end of each of the second members to one of the first members, and the other end of each of the second members to another of the first members. The connections, although occuring at the ends of the second members, need not do so for the first members; in other words, the ends of the second or shorter members may connect at interior point on the first members.

The connecting device further makes sure of a tight fit between the runners in the first and second groups. It does so by coaxing the latter against the former. The tight fit of the runners helps preclude the passage of air containing deleterious contaminants. When connected together in this fashion, the first and second groups of runners create areas between them, usually rectangular in form.

A ledge means then couples to the first and second members. It functions to hold a ceiling component in each of the areas created by the connected runners. In its most convenient form, the ledge means actually represents a ledge connected to the runners and jutting into the areas between them. The ceiling components then sit upon these ledges, where gravity holds them in place.

Lastly, a sealing device couples to the first and second members. It serves to substantially prevent the flow of air between the members and ceiling components held in the areas they create. Again, the sealing serves to preclude the entrance of unfiltered contaminated air into the cleaning room.

For less restrictive clean rooms which may use a dry seal, a gasket attached to the ledges' upper surface upon which the ceiling components sit may well suffice. For more restrictive cleanliness, a trough may sit upon the ledge with caulking between the members and the trough to close off that possible air passageway. The trough may then contain a liquid such as petroleum jelly. The ceiling components will then have knife edges descending from their lower surfaces and sitting within the trough to provide the wet seal.

BRIEF DESCRIPTION OF THE FIGURES

FIG. 1 shows a general diagram of the different types of runners forming a suspended ceiling for a clean room.

FIG. 2 displays various types of runners utilized at the edge of a ceiling.

FIG. 3 shows runners connected to each other and occuring in the interior of the ceiling for a clean room.

FIG. 4 shows, in a cross sectional view along the line 4—4 of FIG. 3, the connection of two cross runners to a main runner. FIG. 4*a* displays a support plate to hold the runners together and to the actual ceiling of a room.

FIGS. 5, 6, and 7 show different types of coupling plates used to adjoin together the runners of a ceiling system.

FIG. 8 shows a dry seal between a runner and a ceiling component as well as a seal between a runner and the clean room's wall.

FIG. 9 displays, in an isometric view, a trough used for a wet seal suspended ceiling system.

FIG. 10 gives a view of a complete rectangle formed from the wet trough displayed in FIG. 9.

FIG. 11 is a cross-sectional view along the line 11—11 of the trough of FIG. 10 showing its placement on and sealed to a runner and also displaying a descending knife edge from a ceiling component placed within it.

DETAILED DESCRIPTION

FIG. 1 shows a runner system generally at 20 for a suspended ceiling for a clean room. The system 20 includes the main runners 21 occuring in the middle of the room as well as the runner 22 occuring at the room's edge. The main runners 21 and 22 connect to the end runner 23 which also has a location at the edge of the room. As FIG. 1 shows, the runners 21, 22, and 23 have substantial length and form the main components of the system.

The system 20 also includes the cross runners 24 to 27. The cross runners 24 to 27 only have sufficient length to extend the distance between two of the main runners 21 and 22. In particular, the cross runners 24 extend between the edge main runner 22 and the middle main runner 21. The other cross runners 25 to 27 only extend the distance between the two adjoining interior main runners 21.

Various types of connections occur between the different runners shown in FIG. 1. Thus the corner connection 30 shown in the dotted circle, adjoins the main runner 22 to the end runner 23. One end connection 31 adjoins the main runner 21 to the end runner 23 while the second end connection 32 adjoins the cross runner 24 to the main runner 22. The two end connections 31 and 32 clearly have the same configuration. Lastly, the cross connection 33 adjoins the cross runners 25 and 26 to the main runner 21. Clearly, the runner system 20 will include enough of the different connections 30 to 33 to form a grid that will cover the ceiling of the clean room.

FIG. 2 provides the details of the extrusion forming the runners 21 to 27 as well as the corner connection 30 and the end connection 31. Specifically, to form the corner connection 30, the main runner 22 connects to the end runner 23 along the 45 degree miter 37. The miter 37 permits the meeting of the various components of the extrusions forming the runners 22 and 23 in a continuous, smooth fashion. The corner cover plate, appearing in phantom at 38, helps secure the two runners 22 and 23 at their connection 37.

In a similar fashion, the main runner 21 connects to the side of the end runner 23. The perimeter plate 39 helps maintain this connection similar to the corner plate 38.

The runner 23 includes the ledges 40 and 41 on its exterior surfaces. In fact, since all of the runners use the same extrusion they all have the same ledges. However, the ledge 40 would prevent the abutment of the runner 21 against the runner 23 without some misalignment. To prevent such misalignment, the runner 21 has undergone the coping and backcutting at its edge 43. This allows the remainder of the front edge 43 of the runner 21 to sit upon the ledge 40 and to make a smooth connection between the runners 21 and 23.

FIG. 3 shows the connection of the two cross runners 25 and 26 to the main runner 21 at the joints 44 and 45, respectively. These actually take a form very similar to the connection of the runner 21 to the end runner 23 shown in FIG. 2. Accordingly, both the runners 25 and 26 receive a coping and backcutting as shown in particular at the edge 46 of the runner 26. The crossed configuration of FIG. 3 makes use of the standard connecting plate 47 shown in phantom.

FIG. 3 shows the main runner 21 terminating at the edge 51. These runners 21 may come in convenient lengths, for example, 12 feet. If the room requires longer main runners, the installer may adjoin several sections to create the required length. To permit the connection between sections of the main runner, the tabs 52 and 53 fit into the slots 54 and 55 created by arms 56 and 57 and 58 and 59, respectively, created during the extrusion of the runner 21. This structure appears more clearly in FIG. 4.

FIG. 4 shows the standard plate 47 holding the cross runner 25 against the left side of the main runner 21. A similar mechanism would hold the second cross runner 26 to the right side of the main runner 21.

In particular, the runner 21 has a general U-shaped configuration formed of the bottom 63 and the two upstanding arms 64 and 65. The two upward arms 64 and 65 have, at their upper edges, the inwardly directed cross arms 66 and 67, respectively. In turn, the cross arms 66 and 67 terminate in the downwardly pointing lips 68 and 69, respectively. Naturally, the runner 21 receives this structure during its original extrusion.

To support the runner 21, the support plate 73 fits between the upward arms 64 and 65 and between the bottom 63 and the cross arms 66 and 67. As seen in FIG. 4*a*, the plate 73 has the grooves 74 and 75 formed into its upper surface near its ends 76 and 77, respectively. The downwardly pointing lips 68 and 69 of the runner 21 then fit into the grooves 74 and 75, respectively.

The steel rod 79 passes through the opening 80 in the main plate 47 and then into the threaded opening 81 of the support plate 73. The steel rod 79, at its other end, then attaches to a structure associated with the true ceiling of the room. The coupling of the threaded end of the steel rod 79 into the opening 81 maintains the support plate 73 at a desired height above the floor of the room. In turn, the support plate 73 bears the weight of the runner 21 through the downwardly directed lips 68 and 69 resting in the grooves 74 and 75 of the plate 73.

The nut 83 sits on the rod 79 and abuts against the main plate 47. By pushing the over plate 47 towards the support plate 73, the nut 83 creates a single solid structure that will not become dislodged through some movement of the component parts.

A similar support plate 84 sits crosswise within the cross runner 25, under the cross arms 85 and 86 attached to the upward arms 87 and 88, as seen more clearly in FIG. 3. The downward lips 89 and 90 sit within grooves formed into the supporting plate 84. The bolt 94 passes through the opening 95 of the main plate 47 and into the threaded opening 96 of the support plate 84. This again results in a solid unit by squeezing the main plate 47 and the support plate 84 together.

The further opening 97 in the over plate 47, as seen in FIG. 5, permits the attachment of the other cross runner 26 on the right side of the main runner 21. In fact, in FIG. 5, each of the openings 80, 95 and 97 may receive bolts which can thread into support plates. In particular, a bolt, may pass through the middle opening 80, at locations where the system does not require support through a steel rod such as the rod 79 shown in the FIG. 4. Stated alternately, the rod 79 functions both as a bolt to retain an over plate to a support plate as well as a supporting member.

As seen in FIGS. 2 and 6, the cross plate 39 need only connect the single runner 21 to the end runner 23 (or, in FIG. 1, the single cross runner 24 to the main runner 22). Accordingly, the cross plate 39 has only the two holes 98 and 99 through which can pass either the threaded rod 79 or the bolt 94. Similarly, as seen from FIGS. 2 and 7, the corner plate 38 need only have the two holes 100 and 101 to join the two runners 22 and 23.

Naturally, if the runners shown in FIGS. 1 through 4 should come apart from each other, the clean room under the ceiling may suffer deleterious contamination. Accordingly, the plates 38, 39 and 47 shown in FIGS. 7, 6, and 5, respectively, include the dimples 103 which extend from their underside. As seen in FIGS. 2 and 3, these projections fit into similar dimples 104 formed in the cross arms 66 and 67 of the main runner 21, the similar cross arms 85 and 86 of the cross runner 25, and the same extensions formed on all the runners which come from the same extrusion.

The placement of the dimples 103 in the plates 38, 39 and 47 into the dimples 104 on the runners keep the various connected runners from separating from each other. Further, the forcing of the plates 38, 39 and 47 against the runners by the support plates 73, with the assistance of the steel rod 79 or the bolts 94, make sure that the dimples 103 of the plates remain seated into the dimples 104 on the runners.

Additionally or alternately, the runners may include the tabs 107 formed in the downwardly descending lips 68, 69, 89, 90, and the like. The support plates 73, held in place by the bolts 94 or the rods 79, fit between the pairs of tabs 107 on each lip at the end of each runner. In other words, the tabs 107 abut against the edges of these supporting plates 73 and 84. If the runners tried to move, the tabs 107 would contact the plates 73 and 84 and prevent such motion. Thus, the dimples 103 and 104 or the tabs 107, or both; serve to preclude undesired motion between the various connecting runners.

With all the runners connected together, a suspension system capable of holding ceiling tiles and fixtures emerges. The suspension system thus developed has substantial strength. As seen in FIG. 4, each of the runners, such as the main runner 21, has a U-shaped configuration. Additionally, the bottom 63 includes the extensions, or ledges, 40 and 41. This, in effect, gives the runners an I-beam configuration. As a result, the suspension system will have substantial strength without requiring a large amount of material and weight in the runners. In fact, the system may well have the capability of supporting the live, or moving, weight of a person walking on top to make connections or repairs.

With a runner system which as shown in FIG. 1 in place, various rectangular areas 108 occur between the runners 21 and 27. As seen from FIGS. 2 and 3, these areas 108 are circumscribed by the ledges 40 or 41 attached to the runners. In fact, each area 108 represents a rectangle surrounded on all four sides by a such a ledge. This rectangular ledge then serves to support a ceiling component which can take the form of a ceiling tile, light fixtures, filter, and the like. The ceiling components, of course, sit upon the ledges 40 and 41.

To prevent the entrance of contaminated air into the clean room, the ceiling system requires a seal between the ceiling component and the ledge 40 or 41. In particular, the gasket seal 109 appears between the ledges 40 and 41 and the ceiling component 110 in FIG. 8. The gasket, formed from the usual sealing materials such as a soft plastic or a rubber, will keep the air from passing between the runner 23 or, more specifically, its ledge 40, and the ceiling component 110.

However, the dry seal provided by the gasket 109 will not suffice for extremely clean rooms. That greater degree of cleanliness requires a wet seal between components to substantially prevent any flow of air.

Accordingly, the ledges 40 and 41, rather than holding a gasket 109, may support the trough 113 shown in FIG. 9. As seen there, the trough 113 has a U-shaped configuration formed of the bottom 114 and the sides 115 and 116. The entire trough 113 will take the rectangular configuration shown generally at 117 in FIG. 10. Each one of the areas 108 between the runners 21 to 27 in FIG. 1 will hold one of the rectangles 113 formed from the trough 117 sitting up upon the ledges 40 and 41.

As seen in FIG. 11, the trough 113 sits directly upon the ledge 40. The caulking 122 prevents the passage of air between the runner 21 and the trough 117. The plastic or other liquid-tight channel 123 sits within the trough 113 and holds the liquid 124. The liquid 124 should have a minimal vapor pressure and may take the form of petroleum jelly. Alternately, sealing the trough 113 permits dispensing with the channel 123; then the liquid sits directly in the trough 113.

To take advantage of the wet seal established by the trough 113 and the channel 123, the ceiling component 127 has the knife edge 128 descending from its lower perimeter. The knife edge 128 sits within the liquid 124 held by the channel 123. This submersion prevents the flow of air between the trough 113 and the ceiling component 127. Yet, it allows for the facile removal, replacement, or exchange of the ceiling component 127 without requiring any disassembly of the entire ceiling system itself.

As seen in the figures, the only difference between the runner system for a dry seal and a wet seal involves the use of the trough 113. To switch between them merely requires placing the trough on the ledges 40 and 41 with the caulking 122 for the wet seal. Alternately, removing the trough 113 and replacing it with the gasket 109 results in a dry seal. This allows the conversion of a moderately clean room to an extremely clean room and vice versa without completely disassembling and reconstructing the room's ceiling.

The clean room's ceiling must also have an air-tight seal with the wall of the room. This appears in FIG. 8 which shows the wall 131 having the expansion-joint seal 132 to the runner 23. The bolts 133 maintain the metal strap 134 against the wall 131 and the runner 23 to assure an air-tight seal.

Alternately, the wall 131 could include the ledge 136 which itself could form part of the ceiling system. In this case, the ledge 136 would have either the gasket 109 or the trough 113 sitting upon it to support a ceiling tile component between it and various runners.

Returning to FIG. 4, the runner 21 has substantial distance vertically between its lower surface 63 and the supporting plate 73 and horizontally between the upstanding arms 64 and 65. This amount of space permits the access of various required services for the clean room. Thus, plumbing pipes, electrical conduits, and even communication cables may pass in the space defined by the U-shaped runner 21. Additionally, the runner 21 provides sufficient space for the attachment and installation of a room sprinkler.

Lastly, the runners 21 to 27 include the threaded slot 137 running their entire lengths on their bottom surface 63. The threaded slot 137 accepts the bolt 138 as seen in FIG. 4. This permits the direct attachment of accessories, such as room partitions, directly to the ceiling.

I claim:

1. A suspension system for a suspended clean room ceiling comprising:

(A) a first plurality of first elongated support members having a U-shaped cross-sectional configuration on a plane taken transverse to the elongated direction, with tops of upstanding arms of said U-shaped members being bent to form cross arms directed toward each other with a separation therebetween and substantially perpendicular to the remainder of said upstanding arms;

(B) a second plurality of second elongated support members, each of said second members being shorter than each of said first members and having a U-shaped cross-sectional configuration on a plane, taken transverse to the elongated direction with tops of upstanding arms of said second U-shaped members being bent to form cross arms directed toward each other with a separation therebetween and substantially perpendicular to the remainder of said upstanding arms;

(C) connecting means, coupled to said first and second sets of members, for (1) affixing one end of each of said second members to one of said first members and the other end of each said second members to another of said first members to create a plurality of areas between said first and second members and (2), when affixing said one or said other end of said second members to said first members, creating a force acting in the plane of the area created by said first and second members, said force acting in a direction to coax said one or said other ends respectively against said first members, said connecting means including (1) first and second support plates each having a length greater than the separation between said cross arms but less than the distance between said upstanding arms of said first and second members, said first and second support plates being placed above the bottom of one of said U-shaped second members and one of said U-shaped first members, respectively, but below the said cross arms of said one second member and one first member, respectively, with said lengths parallel to said separations, respectively, (2) locating means coupled to said cross arms of said one second member for locating said second support plate relative to the end of said one second member, (3) an over plate having a dimension greater than the separation between said cross arms, and (4) first and second affixing means for coupling and positioning said first and second support plates, respectively, to said over plate;

(D) suspending means, coupled to said first or second members, for holding said first or second members at a predetermined height above the floor of a room and including (1) a third support plate having a length greater than the separation between said cross arms but less than the separation distance between said upstanding arms and placed above the bottom of said U-shaped members but below said cross arms with said length parallel to said separation, and (2) a rod coupled to the ceiling at one end and affixed to said first support plate at its other end;

(E) ledge means, coupled to said first and second members, for holding a ceiling component in each of said areas; and (F) sealing means, coupled to said first and second members, for substantially preventing the flow of air between said members and a ceiling component held in one of said areas.

2. The system of claim 1 wherein one end of said one second member contacts the middle of said one of said first members, each of said first and second plates has a hole therethrough, said over plate has first and second holes therethrough, and said affixing means includes first and second bolts passing through said first and second holes through said over plate and into said holes through said first and second support plates, respectively.

3. The system of claim 2 wherein said affixing means is a first affixing means, one end of another of said second members contacts the middle of another of said first members at a particular location and a further of said second members contacts said another first member at about said particular location and further including (1) fourth, fifth, and sixth support plates with each of said fourth, and fifth, and sixth plates having a length greater than the separation between said cross arms but less than the distance to provide consistency between said upstanding arms and placed above the bottom of said U-shaped members but below said cross arms of said another, said further U-shaped second members and said another first U-shaped members, respectively, with said direction parallel to said separation, said fourth, fifth, and sixth support plates including a hole passing therethrough, (2) a second over plate including third, fourth, and fifth holes passing therethrough, (3) third, fourth, and fifth bolts passing through said third, fourth, and fifth holes of said second over plate and into holes passing through said fourth, fifth, and sixth plates, respectively.

4. The system of claim 3 wherein the end of a different second member contacts the end of a different first member and further including (1) seventh and eighth support plates, each of said seventh and eighth support plates having a length greater than the separation between said cross arms but less than the distance between said upstanding arms, each of said seventh and eight support plates having a hole passing therethrough, said sixth and seventh support plates being located below the cross arms and above the bottoms of said different first member and said different second member, respectively, (2) a third over plate having the shape of an L with sixth and seventh holes, with one of said sixth and seventh holes passing through each arm of said over plate, and (3) third affixing means 15 including sixth and seventh bolts passing through said sixth and seventh holes in said third over plate and into the holes through said seventh and eighth support plates, respectively.

5. The system of claim 1 further including compression means, coupled to said rod, for pushing said second and third support plates towards said over plate.

6. A suspension system for a suspended clean room ceiling comprising:

(A) a first plurality of first elongated support members;

(B) a second plurality of second elongated support members, each of said second members being shorter than each of said first members;

(C) connecting means, coupled to said first and second sets of members, for affixing one end of each of said second members to one of said first members and the other end of each said second members to another of said first members to create a plurality of areas between said first and second members, said connecting means including a plate in contact with and connected to a particular first member and to a particular second member, said plate and said particular second member lying above or below each other, one of said plate and said particular second member, at a location where said plate and said particular second member are in contact, having a protuberance directed toward the other of said plate and said particular second member, which has an opening at said location;

(D) suspending means, coupled to said first or second members, for holding said first or second members at a predetermined height above the floor of a room;

(E) ledge means, coupled to said first and second members, for holding a ceiling component in each of said areas; and (F) sealing means, coupled to said first and second members, for substantially preventing the flow of air between said members and a ceiling component held in one of said areas.

7. The system of claim 6 wherein said ledge means holds said ceiling components solely through the force of gravity acting upon said ceiling components resting upon said ledge means.

8. The system of claim 6 wherein said ledge means comprises a ledge coupled to said first and second sets of members and extending into said areas from said first and second members, said ceiling components sitting on said ledge.

9. The system of claim 8 wherein said sealing means is a first sealing means and further including second sealing means coupled to one of said first or said second members and to the wall of a room to substantially prevent the flow of air between said one of said first or second members, respectively, and said walls.

10. The system of claim 9 wherein said first sealing means includes a gasket placed upon and coupled to said ledge upon which said ceiling components sit when occupying said area.

11. The system of claim 10 wherein the lower surfaces of said first and second members, when held by said suspending means, includes a continuous threaded slot extending substantially the length of and formed integrally with said members.

12. The system of claim 9 wherein said ledge is a first ledge and said second sealing means includes (1) a second ledge affixed to said wall at substantially the same height as said first ledge, said second ledge and said first ledge circumscribing an area of a size to hold a ceiling component, and (2) a sealant placed upon and coupled to said second ledge to substantially prevent the flow of air between said second ledge and a ceiling component sitting upon said second ledge.

13. The system of claim 9 wherein said second sealing means includes a flexible expansion joint connected in an air-tight manner to said wall and to one of said first or second members and allowing a component held on said one of said first or second members to move toward and away from said wall while retaining an air tight connection between said wall and said one of said first or second members.

14. The system of claim 8 wherein the bottom of said second member is coped and back cut to a length substantially equal to the width of said ledge of said first member.

15. The system of claim 8 wherein at least one of said first members is composed of a plurality of pieces adjoined to each other.

16. The system of claim 8 wherein said first and second members have a U-shaped cross-sectional configuration on a plane taken transverse to the elongated direction of said first and second members.

17. The system of claim 16 wherein the space between the upstanding arms of said U-shaped members is sufficiently large to hold a room sprinkler head.

18. The system of claim 17 wherein said members have sufficient strength to bear the average live weight of a human being.

19. The system of claim 16 wherein said upstanding arms of said U-shaped members have a distance between them, said distance being sufficiently large to hold electrical conduit and plumbing pipe.

20. The system of claim 16 wherein tops of upstanding arms of said U-shaped members are bent to form cross arms directed toward each other with a separation between said cross arms and substantially perpendicular to the remainder of said upstanding arms and further including (1) a support plate having a length greater than the distance between said cross arms but less than the distance between said upstanding arms and placed above the bottom of said U-shaped members but below said cross arms with said length parallel to said separation, and (2) a rod coupled to the ceiling at one end and affixed to said support plate at its other end.

21. The system of claim 9 wherein the lower surfaces of said first and second members, when held by said suspending means, includes a continuous threaded slot extending substantially the length and formed integrally with of said members.

22. A suspension system for a suspended clean room ceiling comprising:

(A) a first plurality of first elongated support members;

(B) a second plurality of second elongated support members, each of said second members being shorter than each of said first members;

(C) connecting means, coupled to said first and second sets of members, for (1) affixing one end of each of said second members to one of said first members and the other end of each said second members to another of said first members to create a plurality of areas between said first and second members and (2), when affixing said one or said other end of said second members to said first members, creating a force acting in the plane of the area created by said first and second members, said force acting in a direction to coax said one or said other ends respectively against said first members;

(D) suspending means, coupled to said first or second members, for holding said first or second members at a predetermined height above the floor of a room;

(E) ledge means, coupled to said first and second members, for holding a ceiling component in each of said areas and comprising a ledge coupled to said first and second pluralities of members and extending into said areas from said first and second members, said ceiling components sitting on said ledge; and (F) sealing means, coupled to said first and second members, for substantially preventing the flow of air between said members and a ceiling component held in one of said areas, said sealing means including, for each one of a plurality of said areas, a separate U-shaped, substantially liquid tight trough circumscribing said one area and resting upon said ledge, caulking placed between said trough and said first and second members, and a substantially liquid material contained within said trough and a second sealing means is coupled to said ceiling component.

* * * * *